United States Patent [19]

Weyer

[11] Patent Number: 4,858,701

[45] Date of Patent: Aug. 22, 1989

[54] FLUID-POWERED IMPACT DEVICE AND TOOL THEREFOR

[76] Inventor: Paul P. Weyer, 48811 - 284th Ave. SE., Enumclaw, Wash. 98022

[21] Appl. No.: 147,990

[22] Filed: Jan. 25, 1988

Related U.S. Application Data

[63] Continuation-in-part of Ser. No. 126,837, Nov. 30, 1987.

[51] Int. Cl.[4] ..... E21C 3/04; B25D 9/04

[52] U.S. Cl. ..... 173/50; 173/73; 173/105; 74/99 R; 279/19.5; 299/55

[58] Field of Search ..... 173/50, 51, 73, 101, 173/104, 105, 109-111; 74/99 R, 99 A, 89.15; 279/19.5, 19.6, 19.7; 299/46, 55, 57, 62, 69, 81, 94

[56] References Cited

U.S. PATENT DOCUMENTS

| | | | |
|---|---|---|---|
| 458,868 | 9/1891 | Van Depoele | 173/50 X |
| 1,059,188 | 4/1913 | McKinnon | 173/50 X |
| 1,142,983 | 6/1915 | Roberts | 279/19.7 |
| 1,208,224 | 12/1916 | Smith | 279/19.7 X |
| 3,050,033 | 8/1962 | Carey . | |
| 3,183,668 | 5/1965 | Johnson et al. . | |
| 3,307,638 | 3/1967 | Kurt | 173/105 |
| 3,370,655 | 2/1968 | Chromy . | |
| 3,476,418 | 11/1969 | Noerr . | |
| 3,478,829 | 11/1969 | Bixby . | |
| 3,785,444 | 1/1974 | Gray . | |
| 3,885,634 | 5/1975 | Goppen et al. . | |
| 3,903,972 | 9/1975 | Bouyoucos et al. . | |
| 3,990,351 | 11/1976 | Sundin . | |
| 4,002,347 | 1/1977 | Wanner et al. | 173/104 X |
| 4,026,192 | 5/1977 | Noren et al. . | |
| 4,039,033 | 8/1977 | Salmi . | |
| 4,243,110 | 1/1981 | Clemenson et al. . | |
| 4,295,411 | 10/1981 | Grantmyre . | |
| 4,431,062 | 2/1984 | Wanner et al. . | |
| 4,508,180 | 4/1985 | Klueber . | |
| 4,635,531 | 1/1987 | Rode . | |
| 4,685,344 | 8/1987 | Horn et al. | 74/89.15 X |

FOREIGN PATENT DOCUMENTS

| | | | |
|---|---|---|---|
| 0717309 | 2/1980 | U.S.S.R. | 173/105 |

OTHER PUBLICATIONS

Ingersoll-Rand Co., "CM-350/EM 350", 1975, p. 3, Form 4360-B, U.S.A.

*Machine Design*, "U.K.: Save the Oil Rigs", 6/25/87, p. 51.

*Primary Examiner*—Frank T. Yost

*Assistant Examiner*—James L. Wolfe

*Attorney, Agent, or Firm*—Seed and Berry

[57] ABSTRACT

A percussion tool usable as part of a single tool impact device or a multi-tool impact device. In each case, the tool is rotatably driven by a high-torque rotary actuator with the tool being longitudinally splined and received within a correspondingly longitudinally splined hollow drive shaft of the actuator. The tool extends fully through the drive shaft to a rearward end thereof at which is positioned a percussion hammer to provide reciprocating endwise impact to the tool. The tool is held within the drive shaft by a splined lock member which can be rotated between a release position with its splines aligned with the drive shaft splines, and a locked position with its splines misaligned with the drive shaft splines. The device is mountable on a mobile vehicle having an articulated arm. The multi-tool impact devices utilizes six such units in side-by-side relation with the drive shafts of each having a gear which drivable interconnects the shafts to maintain them synchronized and couple them together for the transmission of drive force therebetween.

48 Claims, 5 Drawing Sheets

FLUID-POWERED IMPACT DEVICE AND TOOL THEREFOR

CROSS-REFERENCE TO RELATED APPLICATIONS

This is a continuation-in-part application of copending application Serial No. 126,837, filed Nov. 30, 1987, entitled "FLUID-POWER BEARING ACTUATOR".

TECHNICAL FIELD

The present invention relates generally to breakers and cutters such as used for rock and cement formations, and to mining devices.

BACKGROUND OF THE INVENTION

In the past, the most common demolition tool used was the hand-held pneumatic jackhammer. This type of jackhammer is a back-breaking, noisy implement, and is not suitable for larger jobs. Eventually, heavier pneumatic jackhammers were developed and mounted upon articulated-arm backhoes and other vehicles.

For heavy concrete work or large demolition projects, hydraulic splitters are also frequently employed and operate based on the expanding wedge principal. Such splitters require pre-drilled holes. This means that to accomplish a splitting job additional equipment is required to perform the splitting function besides the splitter. If the job also involves breaking up a work piece, a jackhammer type device is also needed. Of course, each piece of equipment often requires its own operator.

As such, there exists a need for a single device which can perform much like a jackhammer but yet provide the ability to operate as a splitter without requiring pre-drilled holes or additional equipment. It is desirable that the device be mountable on a vehicle so that it can be carried and positioned with ease, but it should not have the drawback of prior art devices mounted on vehicles which require frequent movement of the vehicle in order to appropriately position the working head of the tool used.

The basic device should also be usable in a modified version as a mining tool and provide superior work performance. Preferably, the device when used for mining, should reduce the size of vehicle required, thus allowing a less expensive and more maneuverable vehicle to be used in the mine.

Also, the device should use a tool which is easily and quickly interchangeable, but yet is securely held in the device.

The present invention fulfills these needs and further provides other related advantages.

DISCLOSURE OF INVENTION

In one embodiment, the invention resides in a percussion device for breaking apart or forming cuts or holes in a stationary work piece, such as a rock, cement or other hard material. The invention includes a tool usable with the device and having a working head at a forward end portion, an impact member at a rearward end portion and an elongated shank extending therebetween.

The device includes a fluid-powered rotary actuator with an outer body having a forward end and a rearward end, and having ports for introduction of pressurized fluid within the body. A drive member extends within the body and is supported for rotation relative thereto within a limited rotational range. The drive member has an interior bore extending fully and generally coaxially through the drive member from a forward drive member end to a rearward drive member end. The drive member bore is sized to receive the tool shank therewithin in generally coaxial arrangement with the drive member.

The drive member bore has drive means for transmitting selective rotational drive force from the drive member to the tool as the drive member is selectively rotated within the limited rotational range. The drive means also restrains the tool against rotation when the drive member is held stationary by the application of fluid within the body through the ports. The drive means permits substantially unrestricted axial movement of the tool relative to the drive member within a limited longitudinal range.

The drive member holds the tool working head positioned at the forward body end exterior of the body to engage the work piece and the tool rearward end portion positioned at the body rearward end. The drive member includes lock means at the forward drive member end for locking the tool against forward removal from the drive member bore while permitting substantially unrestricted reciprocal axial movement of the tool within the limited longitudinal range. The tool is moveable axially within the limited longitudinal range to a position whereat the tool rearward end portion is axially endwise impacted by the striker of a percussion hammer which is moveable with reciprocating motion to provide repeated endwise impact to the tool. The striker drives the tool forward when the tool working head is moved into engagement with the work piece.

The device further includes transmission means, disposed within the body and surrounding the drive member, for converting selected application of pressurized fluid within the body through the ports into selected clockwise and counterclockwise rotational drive force to the drive member to move the drive member relative to the body within the limited rotational range by a limited first amount in a clockwise direction and a limited second amount in a counterclockwise direction. In the preferred embodiment a piston is mounted for axial reciprocating movement within the body, with axial forward movement of the piston in response to pressurized fluid causing a corresponding amount of one or the other of the clockwise or counterclockwise movement of the drive member and axial rearward movement of the piston in response to pressurized fluid causing a corresponding amount of the other of the clockwise or counterclockwise movement of the drive member. The application of fluid to the piston can be used to hold the piston stationary within the body and cause the drive member and hence the tool to be held stationary.

In a preferred embodiment of the invention, the device includes a vehicle having a movable arm supporting the hammer and the body for selective general positioning of the body with the tool working head engaging the work piece. Once positioned, the application of fluid pressure within the body is used to rotate or hold stationary the drive member and hence the tool as desired to selectively angularly rotate or hold stationary the tool working head relative to the body. Subsequent further angular rotation of the tool working head is achievable by the further application of pressurized fluid within the body without the need to move the vehicle.

The tool shank has at least a shank portion and a circumferentially extending recess positioned to a side of the shank portion toward the tool working head. The drive member includes an engagement portion of the drive member bore longitudinally positioned to engage the shank portion as the tool reciprocally moves within the limited longitudinal range. The tool shank portion and drive member engagement portion are sized and shaped to matingly mesh to restrict rotation of the tool shank relative to the drive member and to transmit rotational drive force to the tool shank while permitting substantially unrestricted axial movement of the tool relative to the drive member within the limited longitudinal range.

The lock means includes a chuck portion of the drive member at the forward drive member end having an attachment head fixedly attached to a shaft portion of the drive member. A locked member is rotatably attached to the attachment head. The lock member has an aperture sized to receive the tool shank therewithin with the tool shank being in generally coaxial arrangement with the drive member. The lock member aperture has a lock portion sized and shaped so that when the lock member is selectively rotated into a release position the lock portion is circumferentially aligned with the drive member engagement portion to permit insertion and removal of the tool shank portion from the drive member bore. When the tool shank is positioned within the drive member bore with the shank recess and the lock portion longitudinally aligned, the lock member is selectively rotatable into a locked position with the lock portion circumferentially misaligned with the drive member engagement portion to lock the tool shank within the drive member bore while still permitting unrestricted reciprocal axial movement of the tool within the limited longitudinal range. A stop means is provided for preventing rotation of the lock member between the lock and release positions when the device is in use. Contemplated within the scope of the invention, is a combined tool and chuck arrangement as set forth above, and also a tool usable with such a chuck arrangement.

In another embodiment of the invention, a plurality of impact units are held and fixed side-by-side relation with each unit including a tool, body, drive member, percussion hammer and transmission means, as described above. The device is used for mining and in the preferred embodiment of the invention utilizes six such impact units together in a matrix arrangement of three rows, each now having two units.

The mining device further includes pressurized fluid control means for the simultaneous and substantially continuous application of pressurized fluid within the body of each unit to repeatedly and continuously causes rotational movement of each of the drive members and tool working heads driven thereby within the limited rotational range. The rotation is first caused in one rotational direction and then in the other rotational direction. In the preferred embodiment of the invention, the drive member includes a gear portion oriented generally coaxial with the drive shaft and drivingly connected thereto for meshing with adjacent gear portions of adjacent drive members of the plurality of impact units. The gear portions transmit drive force between the adjacent drive members and synchronize the rotation of adjacent tool working heads driven by the adjacent drive members. In the illustrated embodiment, adjacent ones of the drive members and tool working heads are simultaneously rotated in opposite rotational directions.

Other features and advantages of the invention will become apparent from the following detailed description, taken in conjunction with the accompanying drawings.

BEST MODE FOR CARRYING OUT THE INVENTION

Figure 2:
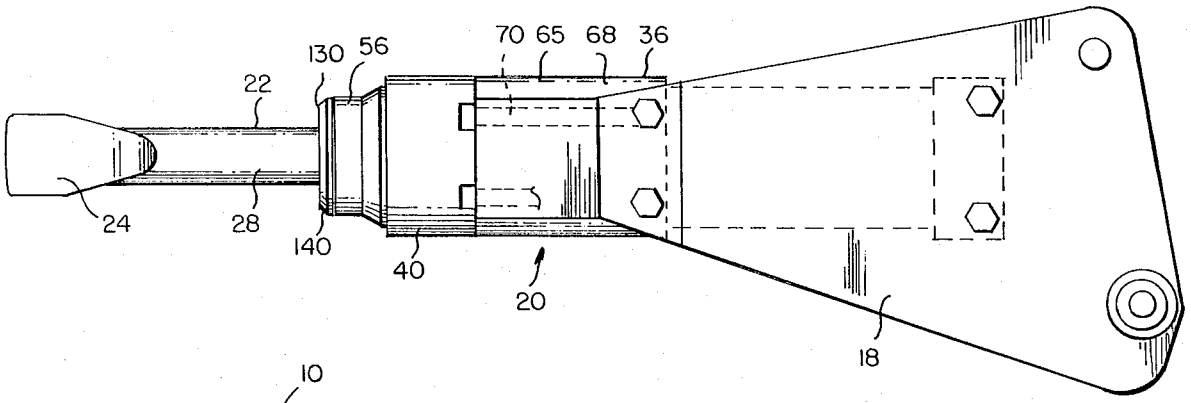
FIG. 2 is an enlarged side elevational view of the single tool impact device of FIG. 1 in greater detail showing in fragmentary its supporting attachment plates.
Figure 1:
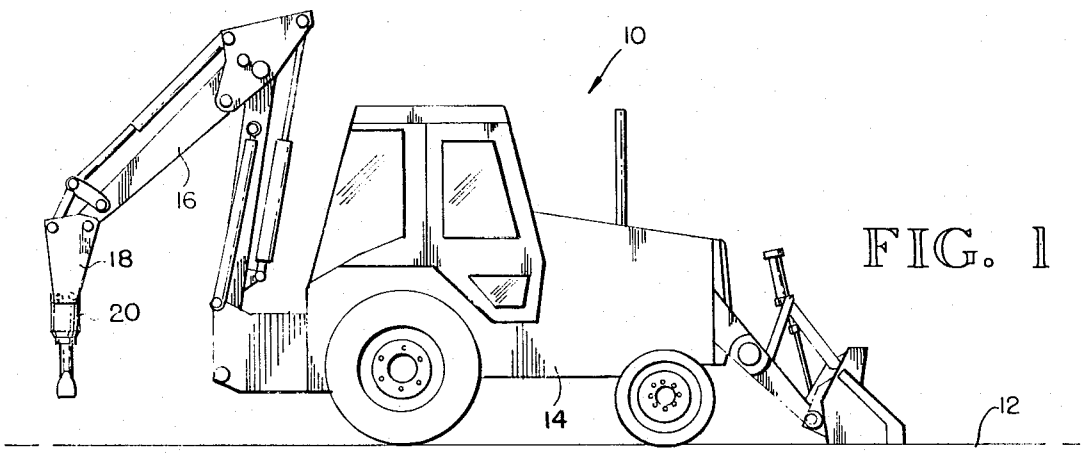
FIG. 1 is a side elevational of a mobile unit with a single tool impact device embodying the present invention.

As shown in the drawings for purposes of illustration, the present invention is embodied in a mobile unit 10. A first embodiment of the mobile unit 10 is shown in FIGS. 1–6 and is usable for breaking apart or forming cuts or holes in a stationary work piece 12, such as a rock, cement or other hard material. The mobile unit 10 includes a relatively lightweight, conventional steerable backhoe-type vehicle 14 having an articulated arm 16. Mounted at a remote end of the arm 16 between a pair of attachment plates 18 is a single tool impact device 20. The attachment plates 18 are pivotable through a vertical plane.

Figure 3:
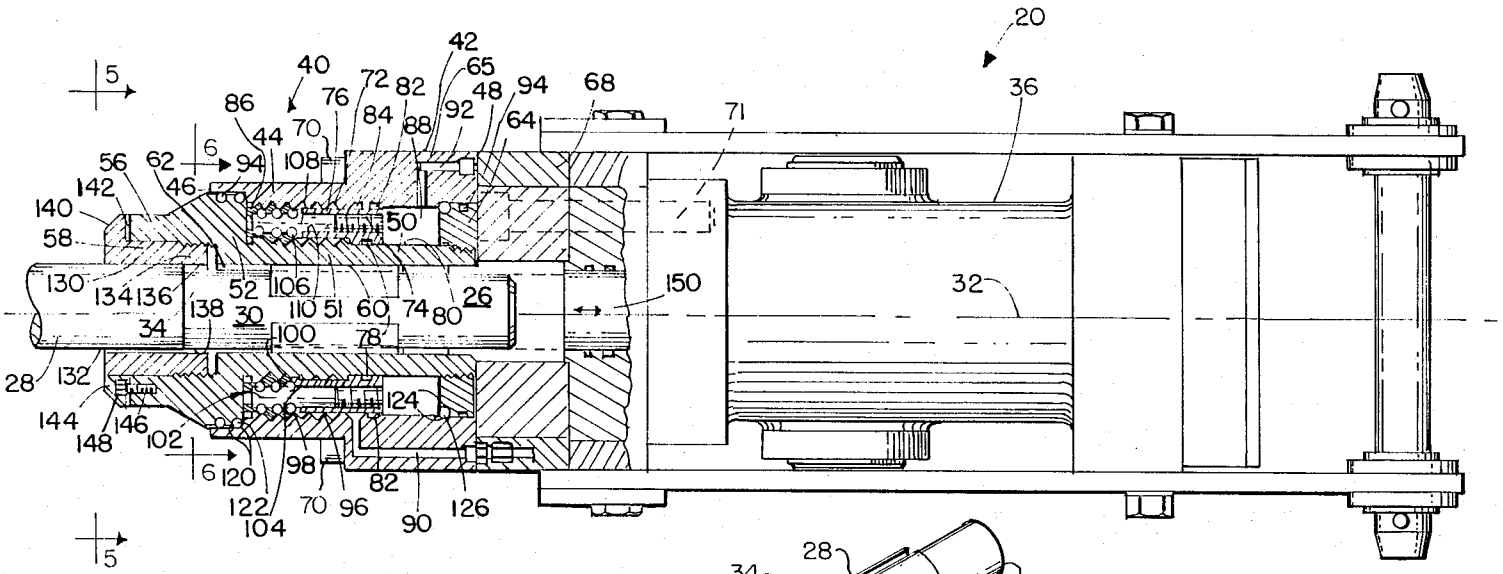
FIG. 3 is an enlarged fragmentary sectional top view of the single tool impact device of FIG. 2 shown with its supporting attachment plates disassembled from the vehicle of FIG. 1.
Figure 4:
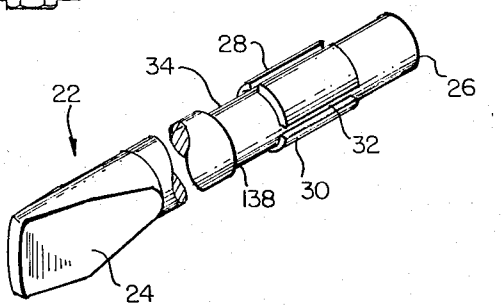
FIG. 4 is a reduced scale, fragmentary isometric view of the tool shown in FIGS. 1–3 illustrated removed from the impact device.

The impact device 20 includes a tool 22 having a working head 24, such as the flattened chisel head shown in FIG. 2, at a forward end thereof. As shown in FIG. 3, the tool 22 further has an impact end 26 at a rearward end thereof. Extending between the working head 24 and impact end 26 of the tool is an elongated shank 28. The shank 28 has a lengthwise portion 30 with longitudinally extending straight splines 32 cut therein and a recess 34 extending circumferentially fully around the shank. The recess 34 is longitudinally positioned along the shank to a side of the shank splines 32 toward the working head 24.

As will be described in more detail below, the tool 22 is selectively rotatable clockwise and counterclockwise within a limited range to both angularly orient the working head 24 and to apply a very large separating or splitting force to the work piece 12 when the working head is positioned within a narrow opening in the work piece to break apart the work piece, such as a rock or cement formation. The narrow opening can be an existing crack or be a crevice formed by the working head itself. This is accomplished, as will be described in more detail below, as a result of repetitive impacting forces applied to the tool impact end 26 by a percussion hammer 36 so that the unit 10, in part, works much like a jack-hammer.

In the presently preferred embodiment of the impact device 20, the rotational force is applied to the tool 22 by a rotary actuator 40 shown in detail in FIG. 3. The actuator 40 includes an elongated housing or body 42 having a cylindrical sidewall 44 and forward and rearward ends 46 and 48, respectively. A hollow rotary output drive shaft 50, having an open ended center bore 49 extending coaxially from end-to-end fully therethrough, is coaxially positioned within the body 42 and supported for rotation relative to the body within a limited rotational range. The drive shaft 50 is substantially coextensive with body 42 at the rearward body end 48 and projects axially outward beyond the forward body end 46.

The drive shaft 50 includes a central elongated portion 51 axially projecting substantially the full length of the body 42 and a radially outward projecting annular flange portion 52 positioned at the forward body end 46. The central elongated shaft portion 51 and the flange portion 52 are formed as an integral unit such as from a single piece of machined stock. As will be described in more detail below, formed integrally with the flange portion 52 is an attachment head portion 56 with an interiorly threaded, enlarged bore 58. The bore 58 is coaxially aligned with and forms a terminal part of the center bore 49. The center bore 49 is sized to receive the tool shank 28 therewithin in coaxial arrangement with the drive shaft 50 and with the body 42. The center bore has a lengthwise portion 60 with longitudinally extending straight splines 62 positioned for meshing snuggly with the shank portion splines 32 to transmit selective rotational drive force to the tool 22 as the drive shaft 50 is selectively rotated within the limited rotational range, and to restrain the tool against rotation when the drive shaft is held stationary. At all times, the drive shaft splines 62 and shank portion splines 32 permit substantially unrestricted axial movement of the tool 22 relative to the drive shaft 50 within a limited longitudinal range.

The central elongated shaft portion 51 has an annular nut 64 threadably attached thereto at the rearward body end 48. The shaft nut 64 has a threaded interior portion threadably attached to a correspondingly threaded perimeter portion of the central elongated shaft portion 51. The shaft nut 64 is locked in place against rotation by a set screw (not shown).

Figure 5:
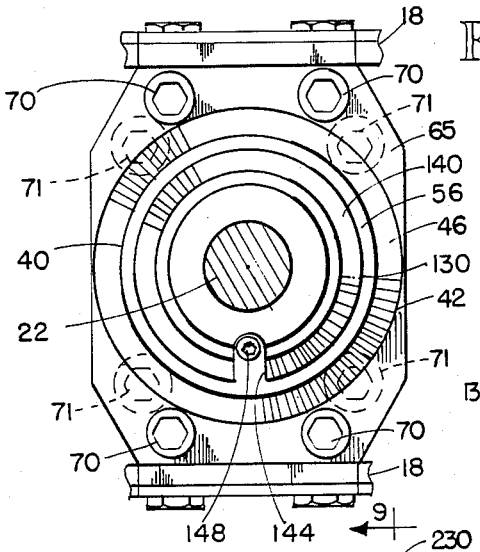
FIG. 5 is a front end elevational view of the tool impact device taken substantially along the line 5—5 of FIG. 3.
Figure 6:
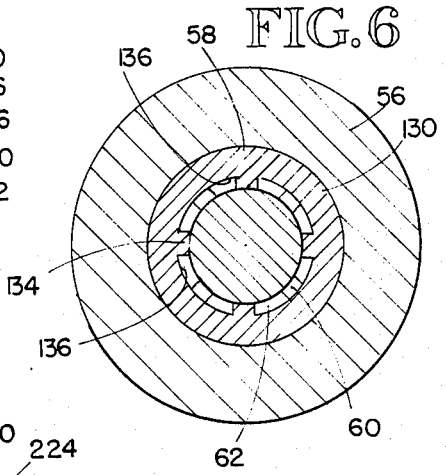
FIG. 6 is an enlarged front end view of the tool attachment head and lock collar of the single tool impact device taken substantially along the line 6—6 of FIG. 3.
Figure 8:
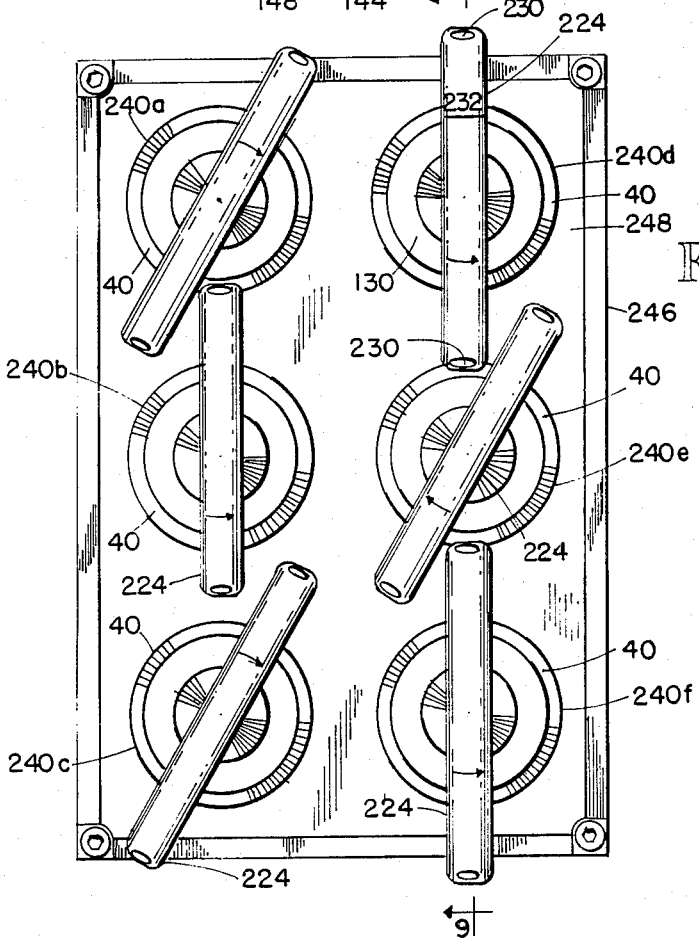
FIG. 8 is an enlarged front elevational view of the multi-tool impact device of FIG. 7.

At the rearward end 48, the body 42 has a radially outward projecting attachment portion 65 having four smooth bore holes for attachment of the body to an annular adapter plate 68 by four bolts 70 (see FIG. 5). Four bolts 71 attach the adapter plate 68 to a forward end face of the percussion hammer 36. The percussion hammer 36 is positioned between and bolted to the attachment plates 18 at the remote end of the vehicle articulated arm 16.

An annular piston sleeve 72 is coaxially and reciprocally mounted within the body 42 coaxially about the central elongated portion 51 of the drive shaft 50. The piston sleeve 72 has an annular piston head portion 74 positioned toward the rearward body end 48, and a cylindrical sleeve portion 76 fixedly attached to the head portion and extending axially therefrom toward the forward body end 46.

The head portion 74 carries a conventional inner seal 78, disposed to provide a seal between the head portion and a corresponding, longitudinally extending smooth wall portion 80 of the drive shaft 50. The body sidewall 44 has a stationary seal 82 positioned along a midportion of the sidewall, disposed to provide a seal between the body sidewall and a corresponding, longitudinally extending smooth wall portion 84 of the head portion 74. The head portion 74, the stationary seal 82 and the inner seal 78 define fluid-tight compartments 86 and 88 to each side of the head portion toward the forward body end 46 and the rearward body end 48, respectively. The smooth wall portion 80 of the drive shaft 50 and the smooth wall portion 84 of the sleeve portion 76 have sufficient axial length to accommodate the full longitudinal end-to-end reciprocating stroke travel of the piston sleeve 72 within the body 42.

Reciprocation of the piston sleeve 72 within the body 42 occurs when hydraulic oil or air under pressure selectively enters through one or the other of a port 90 and a port 92 located in the body sidewall 44, each to an axially opposite side of the stationary seals 82 of the body sidewall. As used herein "fluid" will refer to hydraulic oil, air or any other fluid suitable for use in the actuator 40. The ports 90 and 92 each communicates with one of the fluid-tight compartments 86 and 88, respectively. Conventional seals 94 are disposed between the shaft flange portion 52 and the body 42 toward the forward body end 46 and between the shaft nut 64 and the body 42 toward the rearward body end 48 to prevent fluid leakage from the compartments 86 and 88 as the drive shaft 50 rotates.

The application of fluid pressure to the compartment 86 produces axial movement of the piston sleeve 72 toward the rearward body end 48. The application of fluid pressure to the compartment 86 produces axial movement of the piston sleeve 72 toward the forward body end 46. The actuator 40 provides relative rotational movement between the body 42 and the drive shaft 50 through the conversion of linear movement of the piston sleeve 72 into rotational movement of the drive shaft, in a manner well known in the art.

An inward facing surface portion 96 of the body sidewall 44 extending generally between the stationary seal 82 and the forward body end 46 has cut therein a plurality of inner helical grooves 98. An outward facing surface portion 100 of the central elongated portion 51 of the drive shaft 50 extending generally between the shaft smooth wall portion 80 toward the shaft flange portion 52 has cut therein outer helical grooves 104. The helical body and shaft grooves 98 and 104 extend about the body sidewall 44 and the drive shaft 50, respectively. The grooved shaft portion 100 is located generally opposite the grooved body portion 96 and spaced apart radially inward therefrom to define a circumferential space 102 therebetween. The sleeve portion 76 of the piston sleeve 72 supports a plurality of freely rotatable rollers 108 disposed in the circumferential space 102 between the drive shaft 50 and the body sidewall 44.

The helical body grooves 98 have an opposite hand or direction of turn from the helical shaft grooves 104, but have substantially the same axial pitch as the helical shaft grooves. The number of grooves or groove starts comprising the plurality of helical body and shaft grooves may vary from design to design, but preferably the numbers used are interrelated.

The rollers 106 are disposed in a circumferentially aligned row in the circumferential space 102 between the grooved body portion 96 and the grooved shaft portion 100 and transmit force therebetween. The rollers 106 each have an outer facing surface with a plurality of circumferential grooves with circumferential ridges therebetween. The circumferential grooves and ridges of each roller 106 extend about the roller in parallel spaced apart radial planes. The circumferential ridges of the rollers 106 have substantially the same axial pitch as the helical body and shaft grooves 98 and 104.

The rollers 106 are rotatably retained in fixed axial and circumferential position relative to the piston sleeve 72 as the piston sleeve reciprocates within the body 42 during fluid-powered operation of the actuator 40 by a plurality of cylindrical spindles 108. The spindles 108 are each threadably disposed in one of a plurality of bore holes 110 formed in the piston sleeve 72 in a manner which prevents movement of the splindles relative to the piston sleeve during fluid-powered operation of the actuator 40. The bore holes 110 are evenly circumferentially spaced-apart about the piston sleeve 72 and axially extending fully through the sleeve portion 76 and the head portion 74 of the piston sleeve. Each of the spindles 108 has one of the rollers 106 coaxially and rotatably retained thereon and restrained against axial movement relative to the spindle.

At the first body end 46, the spindles 108 project into the circumferential space 102 between the body sidewall 44 and the drive shaft 50 and hold the rollers 106 restrained against axial movement relative to the piston sleeve 72 for rotation about the spindles on axes in parallel axial alignment with the body 42. In alternative constructions, the spindles may be designed to hold the rollers at a skewed angle.

The spindles 108 retain the rollers 106 in circumferentially distributed, spaced-apart positions within the circumferential space 102 about the shaft 50 with each of the rollers in seated engagement and coacting with the helical body grooves 98 and the helical shaft grooves 104 for transmitting force between the body 42, the drive shaft 50 and the piston sleeve 72. Each ridge of the rollers 106 is positioned for rolling travel in corresponding grooves of both the helical body grooves 98 and the helical shaft grooves 104, and the corresponding ridges of adjacent rollers are axially positioned in generally the same plane or may be axially offset from one another, as desired.

In the embodiment illustrated in FIG. 3, each of the rollers 106 comprises two annular roller disks independently and rotatably disposed on the spindle 108 in juxtaposition. The two roller disks operate together to form one of the rollers 106.

The coaction of the rollers 106 and the helical body and shaft grooves 98 and 104 comprise the linear-to-rotary conversion means which produces rotation of the drive shaft 50 as the piston sleeve 72 reciprocates. Linear reciprocation of the piston sleeve 72 produces rotation of the piston sleeve and the drive shaft 50 through the force-transmitting capability of the rollers 106. Through the application of fluid pressure to the fluid-tight compartments 86 and 88, torque is transmitted by the rollers 106 to the piston sleeve 72 through their coaction with the helical body grooves 98. The axial force created by fluid pressure on the head portion 74 causes the rollers 106 to roll along the helical body grooves 98 and transmit torque to the piston sleeve 72. The transmitted torque causes the piston sleeve 72 to rotate as it moves axially. The resulting linear and rotational movement of the piston sleeve 72 transmits both axial and rotational force to the drive shaft 50 through the coaction of the rollers 106 with the helical shaft grooves 104. The transmitted force causes the drive shaft 50 to rotate relative to the body 42, since axial movement of the drive shaft is restricted by bearings which will be described below. As such, axial movement of the piston sleeve 72 produced by fluid pressure is converted into relative rotational movement between the body 42 and the drive shaft 50. The resulting movement of the rollers 106, body 42 and drive shaft 50 when viewed from the body ends is much like the movement of a planetary gear arrangement. Alternative linear-to-rotary conversion means may also be used, such as conventional sliding splines or balls.

The shaft flange portion 52 and the body sidewall 44 toward the forward body end 46 each have a confronting and corresponding circular ball race 120 integrally formed therein with a plurality of balls 122 disposed between the ball races. The shaft nut 64 and the body sidewall 44 toward the second body end 48 also each have a confronting and corresponding circular ball race 124 integrally formed therein with a plurality of balls 126 disposed between the ball races. These ball races and balls prevent axial movement of the drive shaft 50 relative to the body 42.

By use of the shaft flange portion 52 described above, which extends radially outward far beyond the central elongated shaft portion 51 and has the ball race 120 of the flange portion at an outer edge portion thereof, the drive shaft 50 has greater support against moments applied to the drive shaft than do conventional actuators. In addition, since the shaft flange portion 52 and the central elongated shaft portion 51 are formed as an integral unit, the axial thrust loads applied to the drive shaft 50 are transmitted directly to the body 42 through the ball races 120 and the balls 122 without passing through any joints, such as would be the situation if a threaded joint was used. By way of illustration, this type of threaded joint is used to attach the shaft nut 64 to the central elongated shaft portion 51 at the rearward body end 48. By the use of an integral construction for the central elongated shaft portion 51 and the shaft flange portion 52, maximized load handling ability is achieved with a minimized chance of failure since no joints are needed as when constructed using two separate parts.

The interiorly threaded bore 58 of the attachment head portion 56, which is attached integrally to the shaft flange portion 52 and rotates therewith, is sized to threadably receive an exteriorly threaded, annular lock collar 130. The lock collar 130 is selectively rotatable relative to the attachment head portion 56 for purposes which will be described below. The lock collar 130 includes a central aperture 132 sufficiently large in diameter for endwise passage of the tool impact end 26 and shank 28 therethrough for insertion and removal of the tool shank splined portion 30 within the drive shaft bore 49 from the forward body end 46.

The lock collar aperture 132 has a portion 134 with a short length of longitudinally extending straight splines 136 having a circumferential size and spacing corresponding to the drive shaft splines 62. The lock collar splines 136 have a longitudinal length less than the longitudinal length of the tool shank recess 34. This is so that when the tool shank 28 is positioned within the drive shaft bore 49 with the tool shank splines 32 meshing with the drive shaft splines 62, and with the lock collar splines 136 longitudinally aligned in coincidence with the shank recess 34, the lock collar 130 may be selectively rotated into a lock position. Similarly, the lock collar 130 may be rotated into a release position with the lock collar splines 136 circumferentially aligned in coincidence with the drive shaft splines 62 for easy and rapid insertion and removal of the tool shank 28 into and from the drive shaft bore 49.

When the lock collar 130 is rotated into the lock position, the lock collar splines 136 are circumferentially misaligned out of coincidence with the drive shaft splines 62 and block forward removal of the tool shank 28 from the drive member bore 49, thus locking the tool shank in position for working operation of the impact device 20. When so locked in position by the lock collar 130, the extent of forward and rearwardlongitudinal travel of the tool is limited, but unrestricted reciprocal axial movement of the tool 22 is permitted within the limited longitudinal range. This range is defined by the longitudinal length of the shank recess 34 since the tool 22 can move axially forward until the shank splines 32 engage the lock collar splines 136 which through rotation of the lock collar 130 are out of alignment with the shank splines as well as with the drive shaft splines 62, and can be moved axially rearward until a forwardmost circumferential recess wall 138 defining the shank recess 34 engages the lock collar splines 136.

To prevent the undesired rotation of the lock collar 130 between the lock and release positions when the impact device 20 is in working operation, the lock collar includes an annular flange 140 which projects radially outward and overlays an annular end wall 142 of the attachment head portion 56. The flange 140 has a single cut-out portion or aperture 144 therethrough which is positionable over a threaded bore 146 in the lock collar 130. The flange aperture 144 and lock collar threaded bore 146 are located so as to be in coincidence when the lock collar 130 is rotated into the lock position. When in the lock position with the tool shank 28 within the drive shaft bore 49, a keeper bolt 148 is threaded into the lock collar threaded bore 146 so that its head portion is positioned in the flange aperture 144 to prevent rotation of the lock collar 130 relative to the attachment head portion 56.

When the tool 22 is positioned with the tool shank 28 within the drive member bore 49 with the lock collar 130 in the lock position, the tool working head 24 is positioned forward of the forward body end 46 exterior of the body 42 so as to be able to engage the work piece 12 and the tool impact end 26 is positioned generally at the rearward body end 48. The vehicle 14 and the articulated arm 16 can be moved as desired to generally position and orient the impact device 20, particularly the tool working head 24 thereof relative to the work piece 12. When the impact device 20 is moved to place the tool working head 24 into pressing engagement with the work piece 12, the tool shank 28 moves axially rearward and places the tool impact end 26 into the range of positions whereat a reciprocating striker 150 of the percussion hammer 36 will repeatedly and axially endwise impact the tool impact end to drive the tool 22 and tool working head 24 forward. In FIG. 3 the striker 150 is shown in solid line in the rearward most position of reciprocating travel and in broken line in a more forward position in engagement with the tool impact end 26. The tool 22 is shown at its rearwardmost position.

The actuator 40 is attached to and supported by the percussion hammer 36 in cantilevered manner through the adapter plate 68, with the actuator held in a position whereby the striker 150 is in coaxial alignment with the body 42. The striker 150 has an axially reciprocating motion coaxially aligned with the tool shaft 28. It is noted that pressurized fluid is supplied to the actuator 40 through interior conduits extending through the adapter plate.

In operation, once the impact device 20 is positioned with the tool 22 generally positioned as desired, the selective application of pressurized fluid through one of the actuator ports 90 and 92 will axially move the piston sleeve 72 rearward or forward, as selected, and produce selected and limited rotational clockwise or counterclockwise movement of the drive shaft 50, and hence also of the tool 22, relative to the body 42. This angularly orients the tool work head 24 as desired with respect to the work piece 12. The amount and direction of clockwise or counterclockwise rotational movement of the drive shaft 50 and tool 22 produced directly corresponds to the amount and direction of axial movement of the piston sleeve 72 that occurs through the controlled application of pressurized fluid. The limited length of travel of the actuator piston sleeve 72 and drive shaft 50 inherently provides means to precisely angularly orient the tool working head 24, and means to track the positioning of the tool so that accurate control of the rotational position of the tool is possible.

Once the tool work head 24 is rotated to the desired angular orientation, fluid is applied to both ports 90 and 92 to hold the piston sleeve 72 stationary within the body 42 unable to move in either axial direction. This also holds the drive shaft 50 and hence the tool 22 firmly locked against undesired rotation while the impact device 20 is working on the work piece 12 by the impact force the percussion hammer 36 applies to the tool. There is no need for use of a separate brake mechanism to prevent the tool from rotating when not desired in order to maintain the desired angular setting under the rather substantial forces realized on the tool as the percussion hammer is operating with the tool engaging the work piece. It is noted that since the drive shaft splines 62 and the tool shank splines 32 are straight, the impact force applied by the axially reciprocating striker 150 to the tool impact end 26 is transmitted directly through to tool working head 24 through the tool shank 28 and the percussion blows are not applied at drive shaft 50 which could damage the actuator 40.

Should it be desired to change the angular orientation of the tool working head 24 there is no need to move the vehicle 14, rather pressurized fluid can be selectively applied to the actuator 40 to rotate the tool 22. With little movement of the vehicle other than its articulated arm 16 various angular cut lines and various irregular, rectangular and circular patterns can be cut in the work piece 12. This minimizes the amount of vehicle movement required, thus saving time on the job. Although the tool working head 24 is most times held stationary when the percussion hammer 36 is operated, to form gradually curving cuts or to gradually reorient the tool without lifting it from the workpiece, the actuator 40 can be operated to very slowly rotate the tool while the percussion hammer is operating.

The present invention also allows more job flexibility by increasing the type of jobs for which the mobile unit 10 can be employed since the tool 20 can be angularly oriented so that it can be used for jobs where, if the tool had a fixed angular orientation, the size of the vehicle 14 and the orientation of the tool relative thereto would prevent its use. This sometimes occurs with prior art devices on job locations close to abutments where the abutment prevents the vehicle from being moved into the position necessary to angularly orient the angularly fixed tool necessary to make the desired cut.

Additionally, the ability to rotate the tool 22 with the extremely large torque produced by the rotary actuator 40 allows the mobile unit 10 to be used to split the work piece 12. This is accomplished by first forming a crevice in the work piece angularly oriented as desired through the pre-setting of the tool's angle and using the percussion hammer 36 to impact the tool 22. No other tool is needed to form the crevice. Of course, the tool 22 could also be conveniently rotated so that it is oriented to fit into an existing crack in the work piece, all without having to move the vehicle 14. Once tightly within the crevice formed or the already pre-existing crack, and assuming a non-symmetrical working head tool 24 is used such as the chisel shaped tool 22 shown in FIG. 2, the tool can be rotated with a sufficiently large torque that a separating force is applied to the work piece 12 sufficient to cause the work piece to split or break apart along the crevice or crack. If desired, while the separating force is being applied by rotation of the tool, the percussion hammer may be operated to provide both impact and torque to the work piece to facilitate splitting it. The present invention provides one machine that can be used to both cut and break material, such as rock and cement formations. In the presently preferred embodiment of the invention illustrated, a torque of 2,000 foot-pounds is produced operating at a hydraulic oil fluid pressure of 3,000 pounds per square inch (psi). While the actuator 40 may be designed to rotate the tool 22 by a desired amount, preferably the rotation will be through a total rotational range of 90 to 180 degrees.

It is noted that the percussion hammer 36 used with the impact device 20 has a generally cylindrical case and the actuator 40 is supported by the percussion hammer in cantilevered fashion. The percussion hammer case and actuator body 42 are in generally coaxial arrangement with the percussion hammer in line behind the actuator. The body 42 has an outer diameter smaller than the outer diameter of the hammer case, and a smooth profile combination results without any significant protrusions or attachments at the side of the impact device 20 except for the attachment plates 18. As such, the impact device 20 can reach far into a hole with a width no larger than the outer diameter of the hammer case to engage a work piece at the bottom of or deep within the hole. Additionally, the relatively small size of the impact device 20 and the ability to controllably angularly position the tool 22 and produce large separating force by its rotation makes the impact device ideal for use as a breaker near abutments and other obstructions where conventional breakers cannot fit or adequately maneuver. It is further noted that with the tool and attachment head/lock collar arrangement of the present invention, the entire attachment head/lock collar and actuator used is no larger in length or width than the chuck arrangements presently being used with some conventional rock breakers which do not have the ability to rotationally position the tool. Thus a compact and versatile impact tool device 20 is provided.

Figure 7:
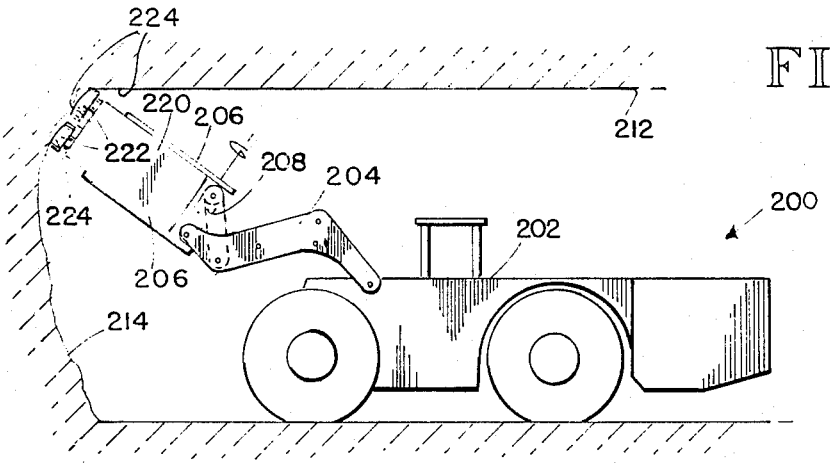
FIG. 7 is a side elevational view of an alternative embodiment of the present invention in the form of a mobile unit with a multi-tool impact device used for mining.

Another embodiment of the invention is shown in FIGS. 7–10 as a mobile unit 200 used for mining. The mobile mining unit 200 includes a relatively lightweight, conventional wheeled vehicle 202 with articulated steering and having a moveable arm 204 which is pivotable through a vertical plane. Mounted at a remote end of the arm 204 between a pair of attachment plates 206 is a multiple tool impact device 220. The attachment plates 206 are attached to the arm 204 through a coupling 208 which allows selective rotation of the mining impact device 220 about an axis 210. The mobile mining unit 200 is shown in FIG. 7 working within a tunnel 212 with the mining device 220 engaging and breaking apart a work surface 214 to increase the length of the tunnel.

For ease of understanding, the similar components of the alternative embodiment of the invention described hereinafter will be identically numbered with those of the first embodiment when of a similar construction. Only the differences in construction will be described in detail.

Figure 9:
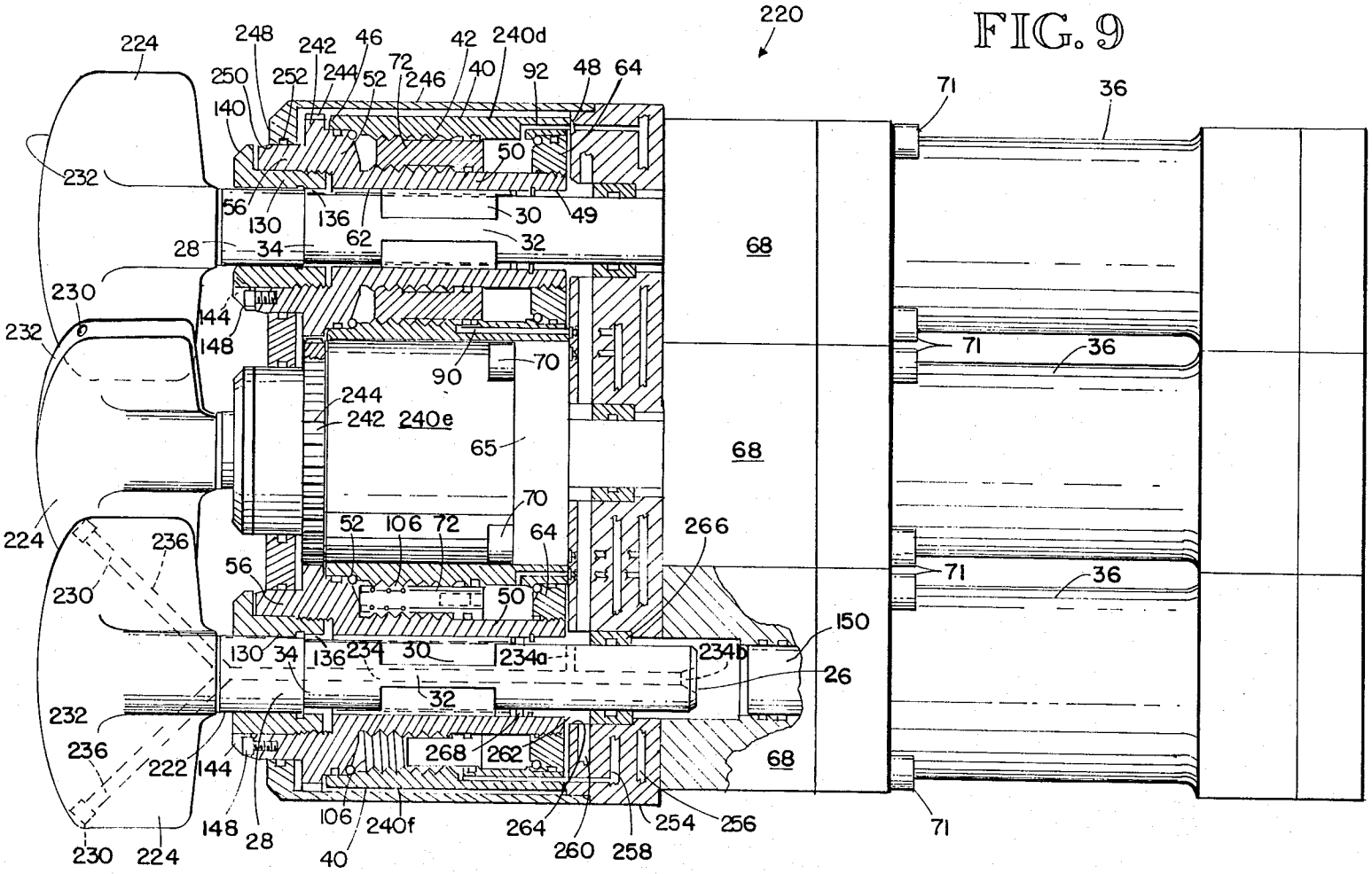
FIG. 9 is an enlarged, fragmentary, sectional side elevational view of the multi-tool impact device taken substantially along the line 9—9 of FIG. 8 showing two styles of rotary actuators which may be used to rotate the tools.

The mining device 220 includes in the presently preferred embodiments six tools 222, each having a workhead 224. As best shown in FIG. 9, each of the tools 222 is identical in construction to the tool 22 used in the single tool impact device 20 of the first embodiment of the invention, except as will be described below. With the tool 222 used with the mining device 220, the working head 224, rather than having a chisel head, has more of a flat paddle shape. Each of the tools 222 has a pair of nozzles 230 in a forward facing end surface 232 of the tool working head 224 which produce a stream of high pressure fluid such as water to assist the tool in cutting through the work surface 214. The nozzles 230 are each positioned to one side or the other of the tool forward facing surface 232 laterally away from the tool shank 28 toward the outer edge of the tool working head 224. The nozzles 230 direct the cutting stream toward the work surface 214 as the tool continuously and slowly rotates back and forth with an oscillating motion, as will be described below.

To supply the high pressure fluid to the nozzles 230, each of the tools has an interior central channel 234 extending the length of the tool shank 28 which communicates with a pair of channels 236 in the tool working head 224. The channels 236 each communicate with one of the nozzles 230. The channel 234 includes a transverse section 234A which has two open ends, each of which are in fluid communication with the water supply. The rearward end of the channel 234 is blocked by a plug 234B.

The six tools 222 of the mining device 220 are each driven by an impact unit 240 identical in construction to the single tool impact device 20 of the first embodiment of the invention shown in FIGS. 1–6, except as will be described below. Each of the six impact units 240 will be shown in the drawings with one of the letters a, b, d, d, e or f used in conjunction with the reference number 240.

As with the single tool impact device 20, each of the impact units 240 includes one of six rotary actuators 40 and the actuators are each mounted to one of six percussion hammers 36. The actuator 40 alternately rotates the one of the six tools 222 forming a part of the impact unit first in one or the other of a clockwise or counterclockwise direction within a limited range and then in the other by the selective application of pressurized fluid to the actuator. With the mining device 220, however, the pressurized fluid is applied simultaneously and substantially continuously to each of the six actuators 40 of the six impact units 240 to slowly and continuously, while the impact units are working, cause oscillatory back and forth clockwise and counterclockwise rotation of the six drive shafts 50 of the six actuators 40. This causes the six tools 222 to slowly and continuously rotate back and forth within the limited range, first in one rotational direction, and then in the other rotational direction. At the same time the oscillatory rotation occurs the six percussion hammers 36 are continuously operating to endwise impact the tool impact ends 26 of the six tools 222. In a preferred embodiment, the tools 222 rotate at 2 revolutions per minute.

The six percussion hammers 36 are positioned in side-by-side relation in three rows each having two of the six impact units 240 devices, as are the six actuators 40 so as to position the six tool working heads 224 together to define a multi-head arrangement to engage the work surface 214. In the embodiment of the actuator 40 used with the impact unit 240, each actuator has a gear portion 242 formed integrally with the flange portion 52 and the attachment head portion 56 of the drive shaft 50. The gear portion 242 is arranged coaxially with the central elongated portion 51 of the drive shaft 50 and has a circumferential toolhead gear surface 244. Each of the gear portions 242 projects radially outward by a sufficient distance that the gear surface 244 of one impact unit engages and meshes with the gear surfaces of each adjacent gear portion.

Figure 10:
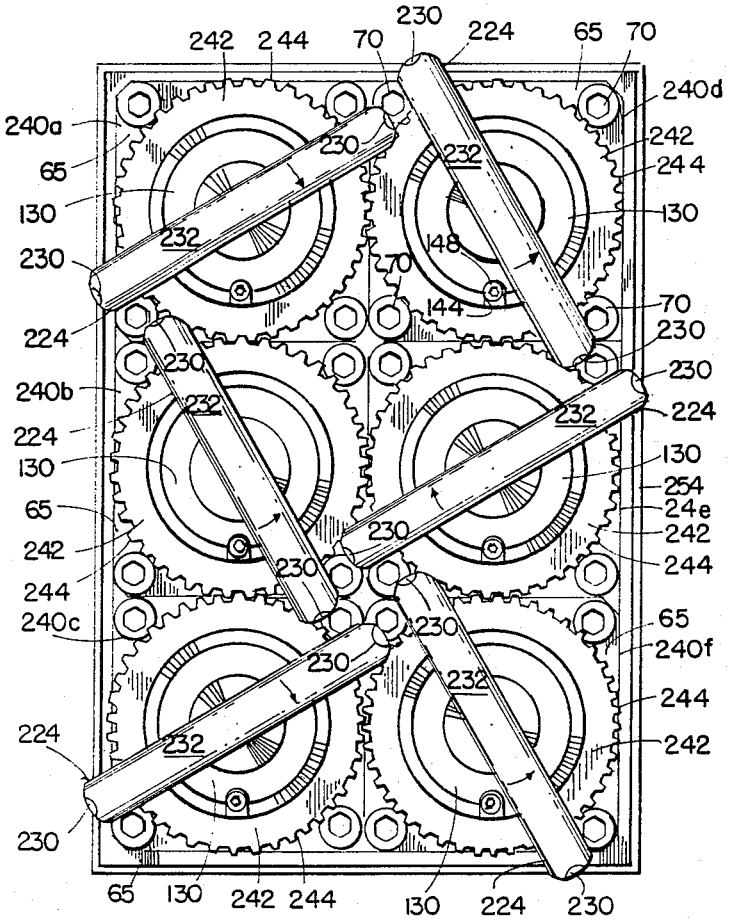
FIG. 10 is a front elevational view of the multi-tool impact device of FIG. 5 with the protective cover removed and with the tool working heads rotated slightly from the rotational orientation shown in FIGS. 8 and 9.

As best illustrated in FIG. 10, the gear portion 242 of the impact unit **240*a* meshes with the gear portions of the two adjacent impact units 240*b* and 240*d*. This is compared with the impact unit 240*b* which has its gear portion 242 meshing with the gear portions of the three adjacent impact units 240*a*, 240*c* and 240*e*. The meshing of the gear portions is to transmit drive force therebetween, for reasons which will be discussed below, while at the same time synchronizing the rotation of the six drive shafts 50**.

The synchronizing is necessary so that the adjacent tool working heads 224 rotated by the adjacent drive shafts 50 can be placed closely together with overlapping contact areas when engaging the work surface 214 without the tools working heads contacting each other which would interfere with the rotation of the adjacent tool working heads. This provides a very effective tool working arrangement with all tool working heads being in engagement with the work surface at substantially all times with an overlapping pattern. The continuous operation of the percussion hammers 36 of the six impact units 240 provide a jack hammer effect by the repeated impacting forces applied to the tool impact ends 26, which in combination with the constant back-and-forth rotation of the tool working heads provide a superior performing cutting action on the work surface 214. This is further supplemented by the use of of high pressure water shot out through the nozzles 230 of the tool working heads 224.

In addition to synchronizing the drive shafts 50 and tool working heads 224, the use of the gear portions 242 meshing with the gear portions of adjacent drive shafts of adjacent impact units 40 has another significant advantage. This advantage is realized when one or more, but not all of the six tool working heads 224 encounters a hard spot in the work surface 214, compared to the material being encountered by the other tool working heads. When this occurs, the combined drive force output of the six actuators 40 are effectively distributed through the meshing gear portions 242 among the six tool working heads on an as needed basis to overcome the hard spot encountered. This is accomplished without the operator having to make any special adjustments or alter the operating mode of the mining device 220 since the drive shafts 50 of all six of the actuators 40 are at all times coupled together through the gear portions 240. This effectively shares the drive force of the outputs of the six actuators between the six tool working heads and when one or more of the six working heads requires less drive force than the other tool working heads to loosen the work surface it is engaging, the excess drive force is coupled to the other tool working heads which require more drive force to operate.

By way of an extreme example, should one tool working head 224 encounter a hard spot which is not broken away while the other tool working heads do break away the work surface 214 they engage, the surface material being engaged by the other tool working heads requires no further drive force to be applied thereto. Thus, the entire collective drive force output of the six actuators will be applied to the one tool working head engaging the hard spot. This applies a tremendously large drive force to the one tool working head encountering the hard spot to break the hard material away. When the hard spot is broken away and all tool working heads are again encountering material in the work surface 214 of about the same normal hardness, the drive force of the six actuators 40 will automatically be distributed among the working heads evenly on an as needed basis. In the presently preferred embodiment of the invention, the six actuators 40 each produce an output torque of 2,000 foot-pounds when operating at a fluid pressure of 3,000 psi, thus the mining device 220 is capable of coupling to a single tool working head 224 a total of 12,000 foot-pounds of torque.

In the presently preferred embodiment of the mining device 220, a single gear direct drive gear portion 240 is used which requires adjacent tool working heads 224 which have meshing drive gear portions to be driven in opposite rotational directions. In other words, if one tool working head is rotated in a clockwise direction, all of the adjacent tool working heads are rotated in a counterclockwise direction. It should be understood that while the mining device 220 is illustrated as having six impact units 240, a multiple tool mining device could be constructed with a larger or smaller number of impact units and a corresponding number to tools 222.

To protect the impact units 240, an exterior protective cover 246 is provided. The cover 246 has a forward end face 248 having six openings 250 formed therein and through which the six attachment head portions 56 of the six impact units 240 forwardly project. A conventional seal 252 is provided at each cover opening 250 to prevent water or debris from entering within the cover 246. The impact units 240 are shown with the protective cover 246 removed in FIG. 10 to illustrate the inermeshing of the gear portions 242 of the six impact units.

In the illustrated embodiment of the mining device 220, the six actuators 40 have a manifold 254 positioned between their rearward body end 48 and the adaptor plate 68. The manifold 254 has channels 256 and 258 formed therein to conduct the pressurized fluid to the appropriate actuator ports 90 and 92, respectively, of the six actuators 40 in order to power the actuators to cause the piston sleeve 72 to linearly reciprocate and hence the drive shaft 50 of the actuator to rotationally oscillate in the appropriate directions. As noted above, the individual actuators must be powered to drive the tool working head of one actuator in the opposite rotational direction from each of the adjacent tool working heads. As also noted above, the tool working heads are constantly and simultaneously being rotated, and hence the actuators must be constantly and simultaneously driven by pressurized fluid alternately supplied through one or the other of two pressurized fluid channels 256 and 258 in the manifold 254.

The manifold 254 also includes a channel 260 which supplies high-pressure water to an interior chamber 262 for each of the actuators 40. The chamber 262 is formed between the rearward body end 48 of the actuator and a corresponding one of six apertures 264 in the manifold through which one tool shank 28 of each actuator extends rearwardly toward the corresponding one of the six percussion hammers 36. Escape of the pressurized water from the chamber 262 is prevented by an annular seal 266 disposed in the aperture 264 and through which the tool shank 28 extends. An annular seal 268 is positioned within the drive shaft center bore 49 of the actuator to prevent the forward escape of pressurized water through the center bore around the tool shank 28.

In the presently preferred embodiment of the mining device 220, the tool working heads 224 are selected having a width extending laterally beyond the actuator 40 which drives the tool working head, and outward beyond the protective cover 246. By so doing, an area of the work surface 214 is cut away by the tool working heads 224 which is larger than the width of the protective cover 246. As such, even when a deep cavity is cut into the portion of the work surface 214 being cut, the sidewalls of the cavity are spaced apart farther than the width of the protective cover 246 and hence do not interfere with and limit the continued operation of the mining device 220 in the cavity. Similarly, this allows sidewall, roof or floor cuts to be made with the mining device oriented generally parallel thereto without the portion of the working surface being cut engaging the protective cover and interfering with operation of the mining device.

With the mobile unit 200 using the mining device 220 of the present invention, the vehicle 14 need not be as large or as heavy as the vehicles normally used in mining since the impact units 240 utilizes both rotational as well as impact forces to cut and break away the work surface. This allows the mining device to be used with a less expensive vehicle, and also a vehicle which is smaller and more maneuverable while still realizing superior cutting ability.

In FIG. 9, the impact unit **240*f* is shown constructed with an actuator 40 having rollers 106 supported by spindles 108, as described above for the embodiment of the actuator used in the single tool impacting device 20. For purposes of illustration, the impact unit 240*d*** is shown with a different construction using an alternative style actuator with a conventional splined piston sleeve.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A mobile percussion device for breaking apart or forming cuts or holes in a stationary work piece, such as a rock, cement or other hard material, comprising:

a tool having a working head at a forward end portion, an impact member at a rearward end portion, and an elongated shank extending therebetween, said shank having at least a lengthwise portion with longitudinally extending substantially straight splines;

an outer generally cylindrical body having a forward end and a rearward end, and having ports for introducing pressurized fluid within said body;

a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxially arrangement with said body, said drive member bore having a lengthwise portion with longitudinally extending substantially straight splines positioned and matingly sized for meshing with said shank portion splines to transmit selective rotational drive force to said tool as said drive member is selectively rotated within said limited rotational range and to restrain said tool against rotation when said drive member is held stationary by the application of fluid within said body through said ports, while permitting substantially unrestricted axial movement of said tool relative to said drive member within a limited longitudinal range, said tool working head being positioned at said forward body end exterior of said body to engage the work piece and said tool rearward end portion being positioned at said body rearward end, said drive member including a chuck portion at said forward drive member end to limit forward axial travel of said tool within said drive member bore and to lock said tool against forward removal of said shank portion from said drive member bore while permitting substantially unrestricted reciprocal axial movement of said tool within said limited longitudinal range;

a percussion hammer attached to and supporting said body at said rearward body end, said hammer having a striker position generally coaxial with said body and axially movable with reciprocating motion to repeatedly and axially endwise impact said tool rearward end portion to drive said tool forward when said tool working head is moved into engagement with the work piece with sufficient force to axially move said tool rearward within said drive member bore such that said tool rearward end is positioned for impact by said reciprocating striker;

linear-to-rotary transmission means, disposed within said body and operable in response to selected application of pressurized fluid within said body through said ports for converting linear movement of a piston into selected and limited rotational clockwise and counterclockwise movement of said drive member relative to said body, said piston being mounted for axial reciprocating movement within said body, axial forward movement of said piston in response to pressurized fluid causing a corresponding amount of one or the other of said clockwise or counterclockwise movement of said drive member and axial rearward movement of said piston in response to pressurized fluid causing a corresponding amount of the other of said clockwise or counterclockwise movement of said drive member, and the application of fluid to hold said piston stationary within said body causing said drive member to be held stationary; and a mobile vehicle having a movable arm supporting said hammer for selective general positioning of said body with said tool working head engaging the work piece, whereby once positioned the application of fluid pressure within said body is used to rotate or hold stationary said drive member and hence said tool as desired to selectively angularly rotate or hold stationary said tool working head relative to said body, with subsequent further angular rotation of said tool working head being achievable by the further application of pressurized fluid within said body without the need to move said vehicle.

2. The device of claim 1 wherein said tool shank has a circumferentially extending recess positioned to a side of said shank portion splines toward said tool working head, and wherein said drive member includes an elongated generally cylindrical shaft portion positioned within said body and within which said splined interior bore is formed, said chuck portion of said drive member including an attachment head fixedly attached to said shaft portion and a lock member rotatably attached to said attachment head, said lock member having an aperture sized to receive said tool shank therewithin with said tool shank being in generally coaxial arrangement with said drive member, said lock member aperture having a portion with longitudinally extending substantially straight splines, said lock member being selectively rotatable into a release position with said lock member splines circumferentially aligned with said drive member splines to permit insertion and removal of said tool shank portion from said drive member bore, and when said tool shank is positioned within said drive member bore with said shank recess and said lock member splines longitudinally aligned, into a lock position with said lock member splines circumferentially misaligned with said drive member splines to lock said tool shank within said drive member bore while permitting unrestricted reciprocal axial movement of said tool within said limited longitudinal range, the device further including stop means for preventing rotation of said lock member between said lock and release positions when the device is in use.

3. A mobile percussion device for breaking apart or forming cuts or holes in a stationary work piece, such as a rock, cement or other hard material, comprising:

a tool having a working head at a forward end portion, an impact member at a rearward end portion, and an elongated shank extending therebetween;

an outer body having a forward end and a rearward end, and having ports for introducing pressurized fluid within said body;

a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said body, said drive member bore having drive means for transmitting selective rotational drive force from said drive member to said tool as said drive member is selectively rotated within said limited rotational range and for restraining said tool against rotation when said drive member is held stationary by the application of fluid within said body through said ports, said drive means permitting substantially unrestricted axial movement of said tool relative to said drive member within a limited longitudinal range, said drive member holding said tool working head positioned at said forward body end exterior of said body to engage the work piece and said tool rearward end portion positioned at said body rearward end, said drive member further including lock means at said forward drive member end for limiting forward axial travel of said tool shank within said drive member bore and locking said tool shank against forward removal from said drive member bore while permitting substantially unrestricted reciprocal axial movement of said tool within said limited longitudinal range;

a percussion hammer attached to said body, said hammer having a striker movable with reciprocating motion to repeatedly and axially endwise impact said tool rearward end portion to drive said tool forward when said tool working head is moved into engagement with the work piece;

transmission means, disposed within said body and surrounding said drive member, for converting the selected application of pressurized fluid within said body through said ports into selected clockwise and counterclockwise rotational drive force to said drive member to move said drive member relative to said body within said limited rotational range by a limited first amount in a clockwise direction and a limited second amount in a counterclockwise direction, and for selectively holding said drive member stationary within said body; and a mobile vehicle having a movable arm supporting said hammer and said body for selective general positioning of said body with said tool working head engaging the work piece, whereby once positioned the application of fluid pressure within said body is used to rotate or hold stationary said drive member and hence said tool as desired to selectively angularly rotate or hold stationary said tool working head relative to said body, with subsequent further angular rotation of said tool working head being achievable by the further application of pressurized fluid within said body without the need to move said vehicle.

4. The device of claim 3 wherein said tool shank has a shank portion and said drive member bore has an engagement portion longitudinally positioned to engage said tool shank portion as said tool reciprocally moves within said limited longitudinal range, said tool shank portion and said drive member engagement portion being sized and shaped to matingly mesh to restrict rotation of said tool shank relative to said drive member and to transmit rotational drive force to said tool shank while permitting substantially unrestricted axial movement of said tool relative to said drive member within said limited longitudinal range.

5. The device of claim 4 wherein said tool shank has a circumferentially extending recess positioned to a side of said shank portion toward said tool working head, and wherein said drive member includes an elongated shaft portion positioned within said body and within which said drive means is positioned, said chuck portion of said drive member including an attachment head fixedly attached to said shaft portion and a lock member rotatably attached to said attachment head and selectively rotatable between a release position and a lock position, said lock member having an aperture sized to receive said tool shank therewithin with said tool shank being in generally coaxial arrangement with said drive member, said lock member aperture having a lock portion sized and shaped so that when said lock member is selectively rotated into said release position said lock portion is circumferentially aligned with said drive member engagement portion to permit insertion and removal of said tool shank portion from said drive member bore, and so that when said tool shank is positioned within said drive member bore with said shank recess and said lock portion longitudinally aligned, said lock member is selectively rotatable into said lock position whereat said lock portion is circumferentially misaligned with said drive member engagement portion to lock said tool shank within said drive member bore while permitting unrestricted reciprocal axial movement of said tool within said limited longitudinal range, the device further including stop means for preventing rotation of said lock member between said lock and release positions when the device is in use.

6. The device of claim 5 wherein said attachment head includes an annular flange extending radially between said drive member shaft portion and said body with bearing means disposed between said flange and said body for rotatably supporting said drive member relative to said body.

7. The device of claim 5 wherein said attachment head and lock member are correspondingly threaded for threaded attachment to each other.

8. The device of claim 5 wherein said attachment head further includes an axially forward projecting annular collar threaded for threaded attachment of said lock member thereto, and wherein said lock member includes an annular collar threaded for threaded attachment to said attachment head collar.

9. The device of claim 8 wherein said lock member further includes an annular flange fixedly attached to said lock member collar, said flange having an aperture therethrough and said attachment head collar having a correspondingly positioned aperture therein with said flange aperture and collar aperture being located in substantial coincidence when said lock member is rotated into said lock position, and wherein said stop means includes a stop member positionable in both said flange and collar apertures when in coincidence to prevent rotation of said lock member relative to said attachment member into said release position.

10. The device of claim 3 wherein said body is generally cylindrical and said percussion hammer has an outer generally cylindrical case with a forward end and a rearward end, said hammer forward end being attached to said body rearward end to provide a cantilevered support for said body with said body and hammer case being in generally coaxial arrangement and said body forward end being a free, unsupported end, said body having an outer diameter less than the outer diameter of said hammer case, whereby the device can reach far into a hole no larger than the outer diameter of the hammer case to engage a work piece at the bottom of the hole.

11. A percussion device for breaking apart or forming cuts or holes in a stationary work piece, such as a rock, cement or other hard material, comprising:

a tool having a working head at a forward end portion, an impact member at a rearward end portion, and an elongated shank extending therebetween, said shank having a shank portion;

an outer body having a forward end and a rearward end, and having ports for introducing pressurized fluid within said body;

a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said body, said drive member bore having an engagement portion longitudinally positioned to engage said tool shank portion, said tool shank portion and drive member engagement portion being sized and shaped to matingly mesh to transmit selective rotational drive force to said tool as said drive member is selectively rotated within said limited rotational range and to restrain said tool against rotation when said drive member is held stationary by the application of fluid within said body through said ports, while permitting substantially unrestricted axial movement of said tool relative to said drive member within a limited longitudinal range, said tool working head being positioned at said forward body end exterior of said body to engage the work piece and said tool rearward end portion being positioned at said body rearward end, said drive member including a chuck portion at said forward drive member end to limit forward axial travel of said tool within said drive member bore and to lock said tool against forward removal of said shank portion from said drive member bore while permitting substantially unrestricted reciprocal axial movement of said tool within said limited longitudinal range;

a percussion hammer attached to said body at said rearward body end, said hammer having a striker positioned generally coaxial with said body and axially movable with reciprocating motion to repeatedly and axially endwise impact said tool rearward end portion to drive said tool forward when said tool working head is moved into engagement with the work piece with sufficient force to axially move said tool rearward within said drive member bore such that said tool rearward end is positioned for impact by said reciprocating striker; and transmission means, disposed within said body and surrounding said drive member, for converting the selected application of pressurized fluid within said body through said ports into selected clockwise and counterclockwise rotational drive force to said drive member to move said drive member relative to said body within said limited rotational range by a limited first amount in a clockwise direction and a limited second amount in a counterclockwise direction, and for selectively holding said drive member stationary within said body.

12. The device of claim 11 wherein said tool shank has a circumferentially extending recess positioned to a side of said shank portion toward said tool working head, and wherein said drive member includes an elongated shaft portion positioned within said body and within which said drive means is positioned, said chuck portion of said drive member including an attachment head fixedly attached to said shaft portion and a lock member rotatably attached to said attachment head and selectively rotatable between a release position and a lock position, said lock member having an aperture sized to receive said tool shank therewithin with said tool shank being in generally coaxial arrangement with said drive member, said lock member aperture having a lock portion sized and shaped so that when said lock member is selectively rotated into said release position said lock portion is circumferentially aligned with said drive member engagement portion to permit insertion and removal of said tool shank portion from said drive member bore, and so that when said tool shank is positioned within said drive member bore with said shank recess and said lock portion longitudinally aligned, said lock member is selectively rotatable into said lock position whereat said lock portion is circumferentially misaligned with said drive member engagement portion to lock said tool shank within said drive member bore while permitting unrestricted reciprocal axial movement of said tool within said limited longitudinal range, the device further including stop means for preventing rotation of said lock member between said lock and release positions when the device is in use.

13. The device of claim 12 wherein said attachment head includes an annular flange extending radially between said drive member shaft portion and said body with bearing means disposed between said flange and said body for rotatably supporting said drive member relative to said body.

14. The device of claim 12 wherein said attachment head and lock member are correspondingly threaded for threaded attachment to each other.

15. The device of claim 12 wherein said attachment head further includes an axially forward projecting annular collar threaded for threaded attachment of said lock member thereto, and wherein said lock member includes an annular collar threaded for threaded attachment to said attachment head collar.

16. The device of claim 15 wherein said lock member further includes an annular flange fixedly attached to said lock member collar, said flange having an aperture therethrough and said attachment head collar having a correspondingly positioned aperture therein with said flange aperture and collar aperture being located in substantial coincidence when said lock member is rotated into said lock position, and wherein said stop means includes a stop member positionable in both said flange and collar apertures when in coincidence to prevent rotation of said lock member relative to said attachment member into said release position.

17. The device of claim 11 wherein said percussion hammer has an outer case with a forward end and a rearward end, said hammer forward end being attached to said body rearward end to provide a cantilevered support for said body with said body and hammer case being in generally coaxial arrangement and said body forward end being a free, unsupported end, said body having an outer axially transverse dimension no greater than the outer axially transverse dimension of said hammer case, whereby the device can reach far into a hole no larger than the outer axially transverse dimension of the hammer case to engage a work piece at the bottom of the hole.

18. A device for breaking apart or forming cuts or holes in a stationary work piece, such as a rock, cement or other hard material, the device being usable with a percussion hammer having a striker movable with reciprocating motion to provide repeated impact, comprising:

a tool having a working head at a forward end portion, an impact member at a rearward end portion, and an elongated shank extending therebetween, said shank having a shank portion;

an outer body having a forward end and a rearward end, and having ports for introducing pressurized fluid within said body;

a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said body, said drive member bore having an engagement portion longitudinally positioned to engage said tool shank portion, said tool shank portion and drive member engagement portion being sized and shaped to matingly mesh to transmit selective rotational drive force to said tool as said drive member is selectively rotated within said limited rotational range and to restrain said tool against rotation when said drive member is held stationary by the application of fluid within said body through said ports, while permitting substantially unrestricted axial movement of said tool relative to said drive member within a limited longitudinal range, said tool working head being positioned at said forward body end exterior of said body to engage the work piece and said tool rearward end portion being positioned at said body rearward end, said drive member including a chuck portion at said forward drive member end to limit forward axial travel of said tool within said drive member bore and to lock said tool against forward removal of said shank portion from said drive member bore while permitting substantially unrestricted reciprocal axial movement of said tool within said limited longitudinal range, said tool being movable axially within said limited longitudinal range to a position whereat said tool rearward end portion is axially endwise impacted by the striker to drive said tool forward when said tool working head is moved into engagement with the work piece with sufficient force to axially move said tool rearward within said drive member bore; and transmission means, disposed within said body and surrounding said drive member, for converting the selected application of pressurized fluid within said body through said ports into selected clockwise and counterclockwise rotational drive force to said drive member to move said drive member relative to said body within said limited rotational range by a limited first amount in a clockwise direction and a limited second amount in a counterclockwise direction, and for selectively holding said drive member stationary within said body.

19. The device of claim 18 wherein said tool shank has a circumferentially extending recess positioned to a side of said shank portion toward said tool working head, and wherein said drive member includes an elongated shaft portion positioned within said body and within which said drive means is positioned, said chuck portion of said drive member including an attachment head fixedly attached to said shaft portion and a lock member rotatably attached to said attachment head and selectively rotatable between a release position and a lock position, said lock member having an aperture sized to receive said tool shank therewithin with said tool shank being in generally coaxial arrangement with said drive member, said lock member aperture having a lock portion sized and shaped so that when said lock member is selectively rotated into said release position said lock portion is circumferentially aligned with said drive member engagement portion to permit insertion and removal of said tool shank portion from said drive member bore, and so that when said tool shank is positioned within said drive member bore with said shank recess and said lock portion longitudinally aligned, said lock member is selectively rotatable into said lock position whereat said lock portion is circumferentially misaligned with said drive member engagement portion to lock said tool shank within said drive member bore while permitting unrestricted reciprocal axial movement of said tool within said limited longitudinal range, the device further including stop means for preventing rotation of said lock member between said lock and release positions when the device is in use.

20. The device of claim 19 wherein said attachment head includes an annular flange extending radially between said drive member shaft portion and said body with bearing means disposed between said flange and said body for rotatably supporting said drive member relative to said body.

21. The device of claim 19 wherein said attachment head and lock member are correspondingly threaded for threaded attachment to each other.

22. The device of claim 21 wherein said attachment head further includes an axially forward projecting annular collar threaded for threaded attachment of said lock member thereto, and wherein said lock member includes an annular collar threaded for threaded attachment to said attachment head collar.

23. The device of claim 22 wherein said lock member further includes an annular flange fixedly attached to said lock member collar, said flange having an aperture therethrough and said attachment head collar having a correspondingly positioned aperture therein with said flange aperture and collar aperture being located in substantial coincidence when said lock member is rotated into said lock position, and wherein said stop means includes a stop member positionable in both said flange and collar apertures when in coincidence to prevent rotation of said lock member relative to said attachment member into said release position.

24. The device of claim 18 wherein said percussion hammer has an outer case with a forward end and a rearward end, said hammer forward end being attached to said body rearward end to provide a cantilevered support for said body with said body and hammer case being in generally coaxial arrangement and said body forward end being a free, unsupported end, said body having an outer axially transverse dimension no greater than the outer axially transverse dimension of said hammer case, whereby the device can reach far into a hole no larger than the outer axially transverse dimension of the hammer case to engage a work piece at the bottom of the hole.

25. A device for breaking apart or forming cuts or holes in a stationary work piece, such as a rock, cement or other hard material, the device being usable with a percussion hammer having a striker movable with reciprocating motion to provide repeated impact, comprising:

a tool having a working head at a forward end portion, an impact member at a rearward end portion, and a shank extending therebetween;

an outer body having a forward end and a rearward end, and having ports for introducing pressurized fluid within said body;

a drive member extending within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said drive member, said drive member bore having drive means for transmitting selective rotational drive force from said drive member to said tool as said drive member is selectively rotated within said limited rotational range by the application of fluid within said body through said ports, said drive means permitting substantially unrestricted axial movement of said tool relative to said drive member within a limited longitudinal range, said drive member holding said tool working head positioned at said forward body end exterior of said body to engage the work piece and said tool rearward end portion positioned at said body rearward end, said drive member end for locking said tool against forward removal from said drive member bore while permitting substantially unrestricted reciprocal axial movement of said tool within said limited longitudinal range, said tool being movable axially within said limited longitudinal range to a position whereat said tool rearward end portion is axially endwise impacted by the striker to drive said tool forward when said tool working head is moved into engagement with the work piece; and transmission means, disposed within said body and surrounding said drive member, for converting the selected application of pressurized fluid within said body through said ports into selected clockwise and counterclockwise rotational drive force to said drive member to move said drive member relative to said body within said limited rotational range by a limited first amount in a clockwise direction and a limited second amount in a counterclockwise direction.

26. A mobile multiple tool mining device for engaging a stationary work surface, comprising:

a plurality of units held fixed in side-by-side relation, each including:

(a) a tool having a working head at a forward end portion, an impact member at a rearward end portion, and an elongated shank extending therebetween, said shank having at least a lengthwise portion with longitudinally extending substantially straight splines;

(b) an outer generally cylindrical body having a forward end and a rearward end, and having ports for introducing pressurized fluid within said body;

(c) a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said body, said drive member bore having a lengthwise portion with longitudinally extending substantially straight splines positioned and matingly sized for meshing with said shank portion splines to transmit rotational drive force to said tool as said drive member is rotated within said limited rotational range by the application of pressurized fluid within said body through said ports, while permitting substantially unrestricted axial movement of said tool relative to said drive member within a limited longitudinal range, said tool working head being positioned at said forward body end exterior of said body to engage the work surface and said tool rearward end portion being positioned at said body rearward end, said drive member including a shaft portion positioned within said body, a chuck portion at said forward drive member end to limit forward axial travel of said tool within said drive member bore and to lock said tool against forward removal of said shank portion from said drive member bore while permitting substantially unrestricted reciprocal axial movement of said tool within said limited longitudinal range, and a gear portion generally coaxial with said shaft portion and drivingly connected thereto for meshing with adjacent gear portions of adjacent drive members of said plurality of units so as to transmit drive force between the adjacent drive members and synchronize the rotation of adjacent tool working heads driven by the adjacent drive members;

(d) a percussion hammer attached to and supporting said body at said rearward body end, said hammer having a striker position generally coaxial with said body and axially movable with reciprocating motion to repeatedly and continuously axially endwise impact said tool rearward end portion while the device is working to drive said tool forward when said tool working head is moved into engagement with the work surface with sufficient force to axially move said tool rearward within said drive member bore such that said tool rearward end is positioned for impact by said reciprocating striker; and (e) linear-to-rotary transmission means, disposed within said body and operable in response to selected application of pressurized fluid within said body through alternating ones of said ports, for converting linear reciprocating movement of a piston into limited rotational movement of said drive member relative to said body alternately in clockwise and counterclockwise directions, said piston being axial mounted for axial reciprocating movement within said body, axial forward movement of said piston in response to pressurized fluid causing a corresponding amount of rotational movement of said drive member in one or the other of said clockwise or counterclockwise directions and axial rearward movement of said piston in response to pressurized fluid causing a corresponding amount of rotational movement of said drive member in the other of said clockwise or counterclockwise directions;

pressurized fluid control means for the simultaneous and substantially continuous alternating application of pressurized fluid within said body through alternating ones of said ports of each of said plurality of units to repeatedly and continuously, while the device is working, cause rotational movement of each of said drive members and tool working heads within said limited rotational range, first in one rotational direction and then in the other rotational direction, with adjacent ones of said drive members and tool working heads being simultaneously rotated in opposite rotational directions; and a mobile vehicle having a movable arm supporting said hammers of said plurality of units in generally side-by-side relation to position said gear portions of adjacent drive members of said plurality of units in driving engagement and to position said tool working heads of said plurality of units so as to work together and define a multiple tool work surface engaging device, said arm being movable to selectively position said plurality of units with said tool working heads engaging the work surface, whereby the application of fluid pressure within each said body of each of said plurality of units is used to simultaneously rotate each of said drive members and hence said tools first in one rotational direction and then in another, with adjacent ones of said tool working heads simultaneously rotating in opposite rotational directions.

27. The device of claim 26 wherein for each of said plurality of units, said tool shank has a circumferentially extending recess positioned to a side of said shank portion splines toward said tool working head, and said drive member includes an elongated generally cylindrical shaft portion positioned within said body and within which said splined interior bore is formed, said chuck portion of said drive member including an attachment head fixedly attached to said shaft portion and a lock member rotatably attached to said attachment head, said lock member having an aperture sized to receive said tool shank therewithin with said tool shank being in generally coaxial arrangement with said drive member, said lock member aperture having a portion with longitudinally extending substantially straight splines, said lock member being selectively rotatable into a release position with said lock member splines circumferentially aligned with said drive member splines to permit insertion and removal of said tool shank portion from said drive member bore, and when said tool shank is positioned within said drive member bore with said shank recess and said lock member splines longitudinally aligned, into a lock position with said lock member splines circumferentially misaligned with said drive member splines to lock said tool shank within said drive member bore while permitting unrestricted reciprocal axial movement of said tool within said limited longitudinal range, each of said plurality of units further including stop means for preventing rotation of said lock member between said lock and release positions when the device is in use.

28. A mobile multiple tool mining device for engaging a stationary work surface, comprising:

a plurality of units held fixed in side-by-side relation, each including (a) a tool having a working head at a forward end portion, an impact member at a rearward end portion, and an elongated shank extending therebetween;

(b) an outer body having a forward end and a rearward end, and having ports for introducing pressurized fluid within said body;

(c) a drive member extending within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said drive member, said drive member bore having drive means for transmitting rotational drive force from said drive member to said tool as said drive member is rotated within said limited rotational range by the application of pressurized fluid within said body through said ports, while permitting substantially unrestricted axial movement of said tool relative to said drive member within a limited longitudinal range, said drive member holding said tool working head positioned at said forward body end exterior of said body to engage the work surface and said tool rearward end portion positioned at said body rearward end, said drive member including lock means at said forward drive member end for locking said tool against forward removal of said shank portion from said drive member bore while permitting substantially unrestricted reciprocal axial movement of said tool within said limited longitudinal range, and a gear portion drivingly connected to said drive member for meshing with adjacent gear portions of adjacent drive members of said plurality of units so as to transmit drive force between the adjacent drive members and synchronize the rotation of adjacent tool working heads driven by the adjacent drive members;

(d) a percussion hammer attached to said body, said hammer having a striker movable with reciprocating motion to repeatedly and continuously axially endwise impact said tool rearward end portion while the device is working to drive said tool forward when said tool working head is in engagement with the work surface; and (e) transmission means, disposed within said body and surrounding said drive member, for converting selected application of pressurized fluid within said body through said ports into alternating clockwise and counterclockwise oscillating rotational drive force to said drive member to move said drive member relative to said body within said limited rotational range alternately by a limited first amount in a clockwise direction and a limited second amount in a counterclockwise direction;

pressurized fluid control means for the simultaneous and substantially continous application of pressurized fluid within said body of each of said plurality of units to repeatedly and continuously, while the device is working, cause rotational movement of each of said drive members and tool working heads within said limited rotational range, first in one of said clockwise or counterclockwise directions and then in the other direction; and a mobile vehicle having a movable arm supporting said plurality of units in generally side-by-side relation to position said gear portions of adjacent drive members of said plurality of units in driving engagement and to position said tool working heads of said plurality of units so as to work together and define a multiple tool work surface engaging device, said arm being movable to selectively position said plurality of units with said tool working heads engaging the work surface, whereby the application of fluid pressure within each said body of each of said plurality of units is used to simultaneously rotate each of said drive members and hence said tools first in one of said clockwise or counterclockwise directions and then in the other direction.

29. The device of claim 28 wherein for each of said plurality of units, said tool shank has a shank portion and said drive member bore has an engagement portion longitudinally positioned to engage said tool shank portion as said tool reciprocally moves within said limited longitudinal range, said tool shank portion and said drive member engagement portion being sized and shaped to matingly mesh to restrict rotation of said tool shank relative to said drive member and to transmit rotational drive force to said tool shank while permitting substantially unrestricted axial movement of said tool relative to said drive member within said limited longitudinal range.

30. The device of 29 wherein for each of said plurality of units, said tool shank has a circumferentially extending recess positioned to a side of said shank portion toward said tool working head, and said drive member includes an elongated shaft portion within said body and within which said drive means is positioned, said chuck portion of said drive member including an attachment head fixedly attached to said shaft portion and a lock member rotatably attached to said attachment head and selectively rotatable between a release position and a lock position, said lock member having an aperture sized to receive said tool shank therewithin with said tool shank being in generally coaxial arrangement with said drive member, said lock member aperture having a lock portion sized and shaped so that when said lock member is selectively rotated into said release position said lock portion is circumferentially aligned with said drive member engagement portion to permit insertion and removal of said tool shank portion from said drive member bore, and so that when said tool shank is positioned within said drive member bore with said shank recess and said lock portion longitudinally aligned, said lock member is selectively rotatable into said lock position whereat said lock portion is circumferentially misaligned with said drive member engagement portion to lock said tool shank within said drive member bore while permitting unrestricted reciprocal axial movement of said tool within said limited longitudinal range, each of said plurality of units further including stop means for preventing rotation of said lock member between said lock and release positions when the device is in use.

31. The device of claim 30 wherein for each of said plurality of units, said attachment head includes an annular flange extending radially between said drive member shaft portion and said body with bearing means disposed between said flange and said body for rotatably supporting said drive member relative to said body.

32. The device of claim 30 wherein for each of said plurality of units, said attachment head and lock member are correspondingly threaded for threaded attachment to each other.

33. The device of claim 30 wherein for each of said plurality of units, said attachment head further includes an axially forward projecting annular collar threaded for threaded attachment of said lock member thereto, and said lock member includes an annular collar threaded for threaded attachment to said attachment head collar.

34. The device of claim 33 wherein for each of said plurality of units, said lock member further includes an annular flange fixedly attached to said lock member collar, said flange having an aperture therethrough and said attachment head collar having a correspondingly positioned aperture therein with said flange aperture and collar aperature being located in substantial coincidence when said lock member is rotated into said lock position, and wherein said stop means includes a stop member positionable in both said flange and collar aperatures when in coincidence to prevent rotation of said lock member relative to said attachment member into said release position.

35. The device of claim 28 wherein for each of said plurality of units said percussion hammer has an outer generally case with a forward end and a rearward end, said hammer forward end being attached to said body rearward end in a substantially coaxial arrangement.

36. The device of claim 35 wherein for each of said plurality of units arranged around the perimeter of said multiple tool device, said tool working head has a work surface engaging portion which extends in a lateral direction transverse to an axis of rotation of said tool by a sufficient amount to engage the work surface at a point laterally outward of said body, whereby said perimeter units work on the work surface so as to avoid said bodies of said perimeter units interferingly engaging the work surface even when a deep hole or edge cut is formed.

37. The device of claim 28 wherein for at least some of said plurality of units said tool working head includes a high pressure fluid nozzle therein for directing a high pressure fluid stream toward the work surface as said tool rotates with sufficient pressure and shape to cut the work surface, and said tool shank has formed therein an interior channel extending between said cutting nozzle and a supply of high pressure fluid, whereby at least some of said tool working heads are assisted by the cutting action of said high pressure fluid stream.

38. The device of claim 28 wherein for at least some of said plurality of units said tool working head is paddle shaped.

39. The device of claim 28 further including a protective cover within which said bodies of said plurality of units are positioned and protected from debris loosened from the work surface.

40. A multiple tool mining device for engaging a stationary work surface, comprising:

a plurality of units held fixed in side-by-side relation, each including:

(a) a tool having a working head at a forward end portion, an impact member at a rearward end portion, and an elongated shank extending therebetween, said shank having a shank portion;

(b) an outer body having a forward end and a rearward end, and having ports for introducing pressurized fluid within said body;

(c) a drive member extending generally coaxially within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said body, said drive member bore having an engagement portion longitudinally positioned to engage said tool shank portion, said tool shank portion and drive member engagement portion being sized and shaped to matingly mesh to transmit rotational drive force to said tool as said drive member is rotated within said limited rotational range by the application of pressurized fluid within said body through said ports, while permitting substantially unrestricted tool relative to said drive member within a limited longitudinal range, said tool working head being positioned at said forward body end exterior of said body to engage the work surface and said tool rearward end portion being positioned at said body rearward end, said drive member including a shaft portion positioned within said body, a chuck portion at said forward drive member end to limit forward axial travel of said tool within said drive member bore and to lock said tool against forward removal of said shank portion from said drive member bore while permitting substantially unrestricted reciprocal axial movement of said tool within said limited longitudinal range, and a gear portion drivingly connected to said shaft portion for meshing with adjacent gear portions of adjacent drive members of said plurality of units so as to transmit drive force between the adjacent drive members and synchronize the rotation of adjacent tool working heads driven by the adjacent drive members;

(d) a percussion hammer attached to said body at said rearward body end, said hammer having a striker positioned generally coaxial with said body and axially movable with reciprocating motion to repeatedly and continuously axially endwise impact said tool rearward end portion while the device is working to drive said tool forward when said tool working head is moved into engagement with the work surface with sufficient force to axially move said tool rearward within said drive member bore such that said tool rearward end is positioned for impact by said reciprocating striker; and (e) transmission means, disposed within said body and surrounding said drive member, for converting the selected application of pressurized fluid within said body through said ports into alternating clockwise and counterclockwise oscillatory rotational drive force to said drive member to move said drive member relative to said body within said limited rotational range alternately by a limited first amount in a clockwise direction and a limited second amount in a counterclockwise direction;

pressurized fluid control means for the simultaneous and substantially continuous application of pressurized fluid within said body of each of said plurality of units to repeatedly and continuously, while the device is working, cause rotational movement of each of said drive members and tool working heads within said limited rotational range, first in one of said clockwise or counterclockwise directions and then in the other direction, with adjacent ones of said drive members and tool working heads being simultaneously rotated in opposite rotational directions; and means for supporting said plurality of units in generally side-by-side relation to position said gear portions of adjacent drive members of said plurality of units in driving engagement and to position said tool working heads of said plurality of units so as to work together and define a multiple tool work surface engaging device.

41. The device of claim 40 wherein for each of said plurality of units, said tool shank has a circumferentially extending recess positioned to a side of said shank portion toward said tool working head, and said drive member includes an elongated shaft portion positioned within said body and within which said drive means is positioned, said chuck portion of said drive member including an attachment head fixedly attached to said shaft portion and a lock member rotatably attached to said attachment head and selectively rotatable between a release position and a lock position, said lock member having an aperture sized to receive said tool shank therewithin with said tool shank being in generally coaxial arrangement with said drive member, said lock member aperture having a lock portion sized and shaped so that when said lock member is selectively rotated into said release position said lock portion is circumferentially aligned with said drive member engagement portion to permit insertion and removal of said tool shank portion from said drive member bore, and so that when said tool shank is positioned within said drive member bore with said shank recess and said lock portion longitudinally aligned, said lock member is selectively rotatable into said lock position whereat said lock portion is circumferentially misaligned with said drive member engagement portion to lock said tool shank within said drive member bore while permitting unrestricted reciprocal axial movement of said tool within said limited longitudinal range, each of said plurality of units further including stop means for preventing rotation of said lock member between said lock and release positions when the device is in use.

42. The device of claim 41 wherein for each of said plurality of units, said attachment head includes an annular flange extending radially between said drive member shaft portion and said body with bearing means disposed between said flange and said body for rotatably supporting said drive member relative to said body.

43. The device of claim 41 wherein for each of said plurality of units, said attachment head and lock member are correspondingly threaded for threaded attachment to each other.

44. The device of claim 41 wherein for each of said plurality of units, said attachment head further includes an axially forward projecting annular collar threaded for threaded attachment of said lock member thereto, said lock member includes an annular collar threaded for threaded attachment to said attachment head collar.

45. The device of claim 44 wherein for each of said plurality of units, said lock member further includes an annular flange attached to said lock member collar, said flange having an aperture therethrough and said attachment head collar having a correspondingly positioned aperture therein with said flange aperture and collar aperture being located in substantial coincidence when said lock member is rotated into said lock position, and wherein said stop means includes a stop member positionable in both said flange and collar apertures when in coincidence to prevent rotation of said lock member relative to said attachment member into said release position.

46. The device of claim 40 wherein for each of said plurality of units said percussion hammer has an outer generally case with a forward end and a rearward end, said hammer forward end being attached to said body rearward end in a substantially coaxial arrangement.

47. The device of claim 46 wherein for each of said plurality of units arranged around the perimeter of said multiple tool device, said tool working head has a work surface engaging portion which extends in a lateral direction transverse to an axis of rotation of said tool by a sufficient amount to engage the work surface at a point laterally outward of said body, whereby said perimeter units work on the work surface so as to avoid said bodies of said perimeter units interferingly engaging the work surface even when a deep hole or edge cut is formed.

48. A multiple tool mining device for engaging a stationary work surface, comprising:

a plurality of units held fixed in side-by-side relation, each including:

(a) a tool having a working head at a forward end portion, an impact member at a rearward end portion, and an elongated shank extending therebetween;

(b) an outer body having a forward end and a rearward end, and having ports for introducing pressurized fluid within said body;

(c) a drive member extending within said body and supported for rotation relative to said body within a limited rotational range, said drive member having an interior bore extending fully and generally coaxially through said drive member from a forward drive member end to a rearward drive member end, said drive member bore being sized to receive said tool shank therewithin in generally coaxial arrangement with said drive member, said drive member bore having drive means for transmitting rotational drive force from said drive member to said tool as said drive member is rotated within said limited rotational range by the application of pressurized fluid within said body through said ports, while permitting substantially unrestricted axial movement of said tool relative to said drive member within a limited longitudinal range, said drive member holding said tool working head positioned at said forward body end exterior of said body to engage the work surface and said tool rearward end portion positioned at said body rearward end, said drive member including lock means at said forward drive member end for locking said tool against forward removal of said shank portion from said drive member bore while permitting substantially unrestricted reciprocal axial movement of said tool within said limited longitudinal range;

(d) a percussion hammer attached to said body, said hammer having a striker movable with reciprocating motion to repeatedly and continuously axially endwise impact said tool rearward end portion while the device is working to drive said tool forward when said tool working head is in engagement with the work surface; and (e) transmission means, disposed within said body and surrounding said drive member, for converting selected application of pressurized fluid within said body through said ports, into alternating clockwise and counterclockwise oscillatory rotational drive force to said drive member to move said drive member relative to said body within said limited rotational range alternately by a limited first amount in a clockwise direction and a limited second amount in a counterclockwise direction;

pressurized fluid control means for the simultaneous and substantially continuous application of pressurized fluid within said body of each of said plurality of units to repeatedly and continuously, while the device is working, cause rotational movement of each of said drive members and tool working heads within said limited rotational range, first in one of said clockwise or counterclockwise directions and then in the other direction; and means for supporting said plurality of units in generally side-by-side relation to position said tool working heads of said plurality of units so as to work together and define a multiple tool work surface engaging device.

* * * * *

UNITED STATES PATENT AND TRADEMARK OFFICE

CERTIFICATE OF CORRECTION

PATENT NO. : 4,858,701

DATED : August 22, 1989

INVENTOR(S) : Paul P. Weyer

It is certified that error appears in the above-identified patent and that said Letters Patent is hereby corrected as shown below:

In claim 1, column 16, line 28, delete "coaxially" and substitute therefor --coaxial--.

In claim 25, column 24, line 44, following "said drive member" insert --including lock means at said forward drive member--.

In claim 28, column 27, line 63, delete "oscillating" and substitute therefor --oscillatory--.

In claim 45, column 32, line 5, following "annular flange" insert --fixedly--.

Signed and Sealed this

Nineteenth Day of June, 1990

*Attest:*

HARRY F. MANBECK, JR.

*Attesting Officer*

*Commissioner of Patents and Trademarks*